United States Patent [19]

Greenberg

[11] 3,945,497

[45] Mar. 23, 1976

[54] STORAGE APPLIANCE

[75] Inventor: Percy Greenberg, Minneapolis, Minn.

[73] Assignee: Norman Goldetsky, Minneapolis, Minn. ; a part interest

[22] Filed: Aug. 21, 1974

[21] Appl. No.: 499,305

Related U.S. Application Data

[63] Continuation-in-part of Ser. No. 391,929, Aug. 27, 1973.

[52] U.S. Cl. ..... 211/60 R; 108/53; 211/49 R; 211/177

[51] Int. Cl.[2] ..... B65D 19/38

[58] Field of Search..... 211/60 R, 60 S, 49 R, 177; 108/53

[56] References Cited

UNITED STATES PATENTS

| | | | |
|---|---|---|---|
| 2,149,589 | 3/1939 | Duaei | 211/60 R |
| 2,591,049 | 4/1952 | Butsch | 211/60 R |
| 2,686,645 | 8/1954 | Whitehurst et al. | 108/53 |
| 3,537,599 | 11/1970 | Jay | 211/60 X |
| 3,581,907 | 6/1971 | Schmidt | 211/177 |
| 3,643,988 | 2/1972 | Ingvartsen | 108/53 X |
| 3,783,800 | 1/1974 | Bucker | 108/53 |

FOREIGN PATENTS OR APPLICATIONS

| | | | |
|---|---|---|---|
| 897,147 | 5/1962 | United Kingdom | 211/60 R |
| 212,214 | 5/1960 | Austria | 211/148 |

*Primary Examiner*—Roy D. Frazier
*Assistant Examiner*—Robert W. Gibson, Jr.
*Attorney, Agent, or Firm*—Lew Schwartz; Wayne A. Sivertson

[57] ABSTRACT

A storage appliance for use with tubing, pipes and similar items. A generally U-shaped member carries a peg at a distal end of each of its legs and a coupling device at their proximal end. The pegs have a first portion of a generally circular cross section and taper to a rounded point at one terminus. The coupling device has an aperture of the same general cross section as the peg first portion. A storage rack is assembled from the appliances by inserting the pegs of one appliance into the coupling devices of another, the number of appliances used being dependent upon the particular storage requirement. The distal ends of the legs of each appliance are made flat to provide a mating surface for an appliance placed thereon while the tapered pegs allow a cooperation between the pegs of one appliance and the coupling device of another even when the legs of the peg-carrying appliance are spread due to loading or otherwise. The circular cross section of the pegs allow an empty appliance to be pivoted about one of the pegs to fully expose the items stored in the appliance immediately below. The pivoted appliance may be thus stored on the storage rack until it is needed. Further, a storage rack assembled from the appliances of the present invention allows a compartmentalized inventory control.

2 Claims, 6 Drawing Figures

STORAGE APPLIANCE

CROSS-REFERENCE TO RELATED APPLICATIONS

This application is a continuation-in-part of my copending application, Ser. No. 391,929, filed Aug. 27, 1973, entitled: STORAGE APPLIANCE.

BACKGROUND OF THE INVENTION

The efficient storage and inventorying of cylindrical items such as tubing and pipes has long been a problem. Typical of prior art storage systems for cylindrical items is a double row of upstanding members between which the items to be placed are stored. This system allows the placing of stored members upon each other while restraining their natural tendency to roll. However, it is necessary that the upstanding members be made sufficiently tall to accommodate the maximum number of items to be stored without regard to the actual number being stored. This necessarily results in an unduly, combersome loading of the storage area. In addition, the cylindrical cross section of items such as tubing and pipes and their resulting tendency to roll produces an outward force against the upstanding members which force restricts the height to which the cylindrical items can be stored or, alternatively, requires a cross bracing or some other restraint which severely limits the utility of the storage system. Further, an inventory of the materials stored within such a storage area requires the individual counting of each item.

BRIEF DESCRIPTION OF THE PRESENT INVENTION

The present invention provides an appliance for the efficient storage of tubing, pipes and similar items. A generally U-shaped member is formed by an elongated support having first and second spacers extending therefrom. The spacers carry a peg at their distal end, the peg having a first portion of a generally circular cross section and taper to a rounded point at their terminus. A coupling device having an aperture of the same general cross section as the peg first portion is carried by the spacers at their proximal end. By inserting the pegs of one appliance into the coupling devices of another, a compartmentalized storage rack may be formed. The height of the storage rack closely approximates the height required to store the desired number of items, the height being readily altered by the utilization or removal of additional appliances. Further, the supporting members of each appliance automatically provide the cross bracing often required in the prior art systems but, in a manner which is not burdensome to the loading or unloading of the storage rack. In addition, by placing a predetermined number of items or bundles of items in each storage compartment and removing items only from the top compartment, inventorying of the storage rack is greatly facilitated, it being necessary to count individually only items or bundles of items within the top compartment. When the top compartment is empty, the appliance or appliances which form it may be pivoted about one of the pegs to fully expose the next lower compartment. The pivoted appliances may be stored on the storage rack in the pivoted position until more storage space is needed. In a preferred embodiment, the storage appliance of the present invention may be provided with pegs of different heights, the shorter peg facilitating disengagement from the coupling devices of another appliance so that the other appliance may be pivoted about the longer peg.

These and other objects, advantages, and novel features of the present invention will become apparent from the following detailed description of the invention when considered in conjunction with the accompanying drawings.

DESCRIPTION OF THE PREFERRED EMBODIMENT

Figure 1:
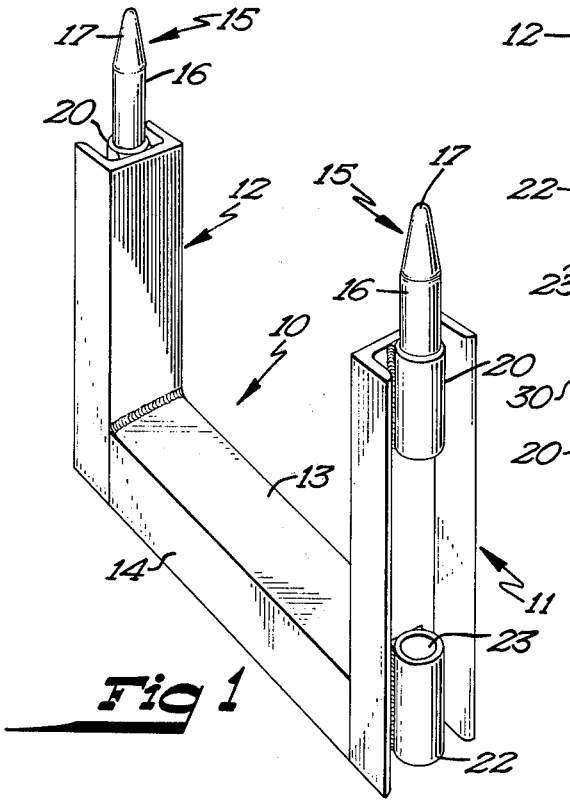
FIG. 1 shows a preferred embodiment of the present invention.

FIG. 1, which illustrates a preferred embodiment of the appliance of the present invention, shows an elongated support member 10 having first and second spacing members 11 and 12 extending from the support member 10 at the end thereof. While the spacing members 11 and 12 are illustrated as being attached to and extending from the ends of the support member 10, it is to be understood that they may extend from any portion of the support member 10, the top surface 13 or side 14, for example. Further, the spacing members 11 and 12 may be unitary with the support member 10 or, alternatively, they may be separately fabricated and attached to the support member 10 in any known manner, welding, for example. The support member 10 and spacing members 11 and 12 are illustrated as being fabricated from channels. It is to be recognized that this is an illustration of a preferred embodiment and that these members may be formed from any desired structural shape such as angles or beams of any configuration. However, it is desirable that the surface corresponding to the top surface 13 of support member 10 and the inner faces of spacing members 11 and 12 be flat no matter what configuration is used. This flat surface provides a stable platform having no projections to mar or damage the stored materials.

Spacing members 11 and 12 each carry a peg 15 at their distal end. The pegs 15 have a first portion 16 of a generally circular cross section and taper to a rounded point at their terminus 17. The pegs 15 are carried by the spacing members 11 and 12 through a peg holder 10. As illustrated, the peg holder 20 has a cylindrical configuration and an aperture of generally the same configuration as the portion 16 of the peg 15 into which the portion 16 is inserted. The peg 15 may be permanently affixed within the peg holder 20 as by welding, for example, or alternatively, the peg holder 20 may be provided with a stop (not shown) which will maintain the peg 15 in the extended position illustrated. It is to be understood, that the peg holder 20 may be of any configuration and may be attached to the spacing members 11 and 12 by any known manner, welding, for example. Alternatively, the peg holder 20 may be eliminated and the peg 15 itself attached to the spacing members 11 and 12.

A coupling device 22 is carried at the proximal end of the spacing members 11 and 12 (here illustrated with respect to spacing member 11 only). In the embodiment illustrated, the coupling device 22 is essentially identical to the peg holder 20. That is, the coupling device is generally cylindrical and has an aperture 23 whose cross section generally corresponds to the circular cross section of the portion 16 of peg 15. The particular configuration of the coupling device 22 forms no part of the present invention, it being important only that the aperture 23 correspond to the circular cross section of the portion 16 of peg 15.

Figure 2:
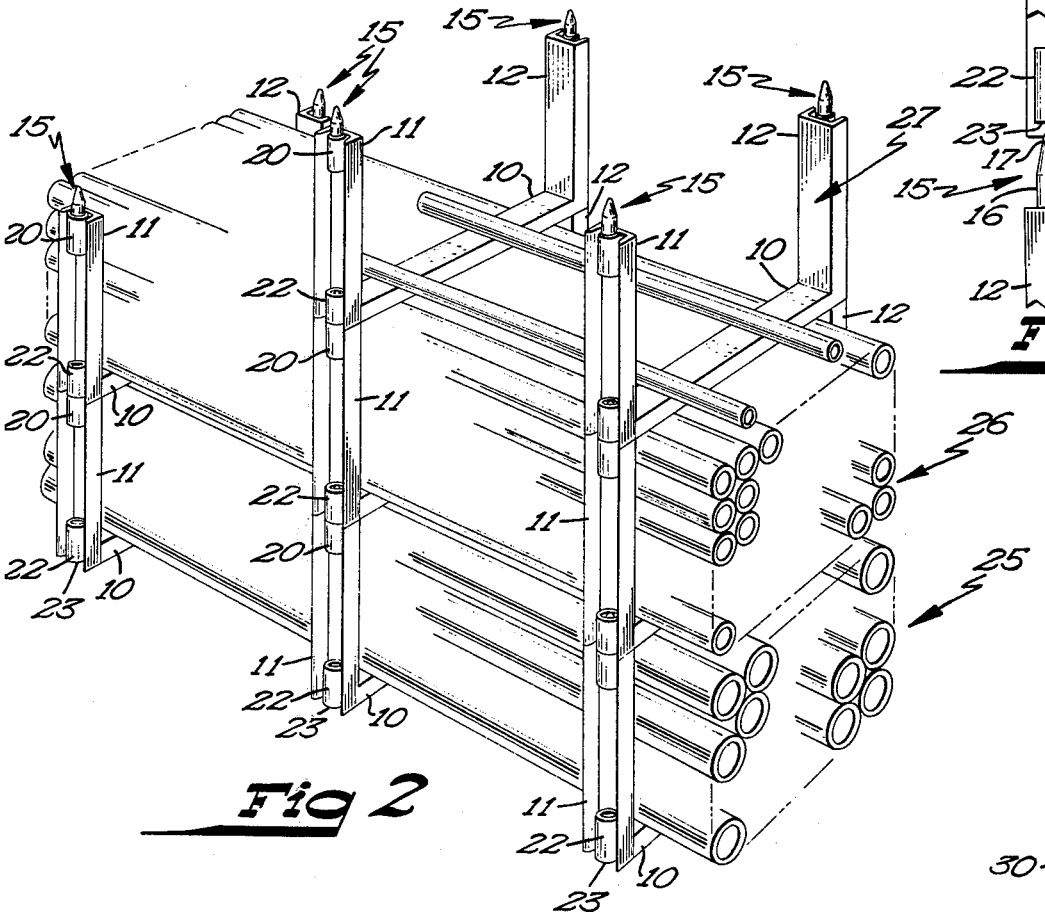
FIG. 2 illustrates a storage rack assembled through the use of the preferred embodiment of FIG. 1.

Referring now to FIG. 2, there is shown a three column storage rack formed with the preferred embodiment of FIG. 1. Each of the columns is formed by placing the pegs 15 of one appliance into the coupling devices 22 of another in a manner to be described more fully below. Any number of columns may be formed in this manner, the number used being dependent upon the length of the materials to be stored, their weight and other similar factors. Similarly, the number of appliances and thus, the number of compartments within the rack, is determined by the total number of the materials to be stored and the number to be stored within each compartment. For example, assuming that the materials illustrated in FIG. 2 were initially positioned within the rack at 50 per compartment and that no materials were taken except from the uppermost compartment, a glance immediately determines that there are 102 items left in the rack — 50 in the bottom compartment 25, 50 in the middle compartment 26 and 2 in the top compartment 27.

Figure 3:
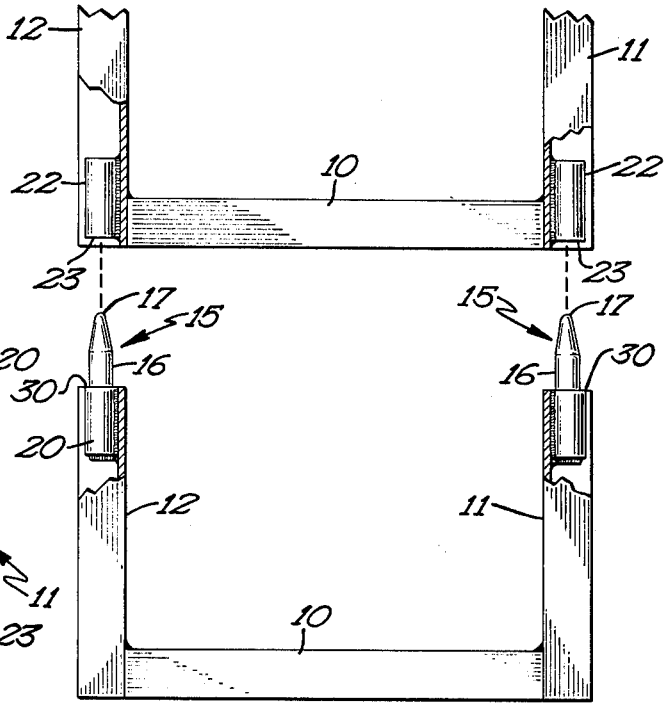
FIG. 3 illustrates an operational feature of the preferred embodiment of FIG. 1.
Figure 5:
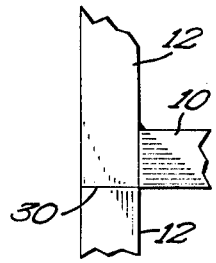
FIG. 5 illustrates a further operational feature of the preferred embodiment of FIG. 1.

Referring now to FIG. 3, there is shown the cooperation between appliances of the type illustrated in FIG. 1. Specifically, appliance 28 is illustrated with its pegs 15 extending upwardly. A second appliance 29 is positioned above the appliance 28 with the coupling devices 22 in position over the peg 15. As stated above, the coupling devices 22 have an aperture whose configuration corresponds to the circular cross section of the portion 16 of the peg 15 so that when the appliance 29 is lowered, the pegs 15 will engage the aperture of the coupling devices 22 to provide a firm restraint against horizontal movement. Further, the end 30 of the spacing members 11 and 12 from which the pegs 15 project are made flat to provide a mating surface with the appliance 29. The mating of the appliances 28 and 29 is illustrated in FIG. 5. Thus, with the pegs 15 inserted into the coupling devices 22, a stable column is provided with the pin-coupling device combination providing a restraint against horizontal movement and the mating surface 30 tending to eliminate any "rocking" between the appliances 28 and 29.

Figure 4:
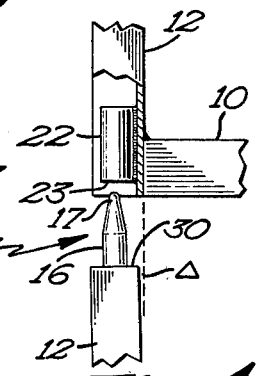
FIG. 4 illustrates an additional operational feature of the preferred embodiment of FIG. 1.

As stated above with regard to the pior art storage systems, the loading of materials between upright members tends to spread them from each other. As can be seen, the support members 10 which occur periodically throughout a column of appliances tend to eliminate this problem. However, it is present in any member to which a sufficient outward force is applied. In FIG. 4, there is shown a portion of the appliances 28 and 29 of FIG. 3, it being assumed that the appliance 28 is loaded so that the spacing members 11 and 12 have, indeed, spread — the spread being illustrated in FIG. 4 as the distance Δ. Recalling that the portion 16 of the peg 15 has the same cross section as the aperture through the member 22, this spread would make impossible the placement of the appliance 29 onto the appliance 28 to form a column were it not for the tapered end 17 of the peg 15. As can be seen in FIG. 4 this taper allows the peg 15 to engage the aperture 23 through the coupling device 22 to urge the spacing members 11 and 12 of the appliance 28 against the force of the stored materials such that the appliance 29 can be placed in mating engagement with the appliance 28 as illustrated in FIG. 5 to provide a stable rack.

When the top compartment 27 (see FIG. 2) is empty, it is desirable to remove the appliances which form that compartment to fully expose the next lower compartment 26. The circular cross section of the portion 16 of the pegs 15, and the cooperating coupling device apertures 23, allow this removal while providing storage for the removed appliance. That is, one coupling device 22 of each of the storage appliances which form an empty compartment may be disengaged from its cooperating peg 15 while the other peg 15 and coupling device 22 remain engaged. The circular cross section of the portion 16 of the engaged peg 15 will then allow the appliance or appliances which form the empty compartment to be pivoted about that peg away from a position over the next lower compartment 26 to expose that compartment while retaining the pivoted storage appliances on the storage rack for future use.

Figure 6:
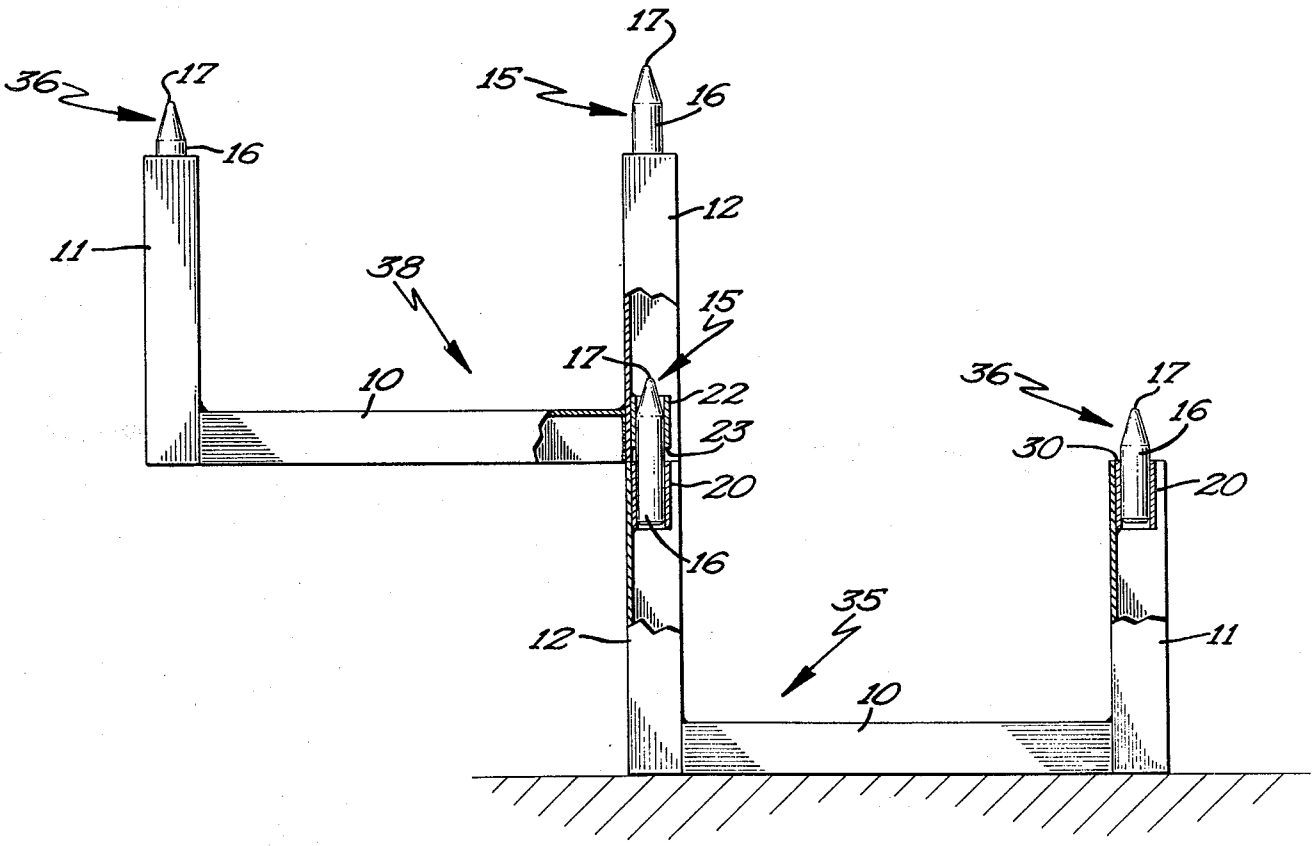
FIG. 6 illustrates a still further operational feature of the present invention and a modification to the preferred embodiment of FIG. 1.

FIG. 6 illustrates two storage appliances in "pivoted" relation. The appliance 35 has one of its pegs 15 engaging the coupling device 22 of a second appliance 38, with the peg 15 extending into the coupling device 22 an amount which is sufficient to support the appliance 38. The second peg carried by the appliance 35 may be made shorter than the peg 15 to facilitate disengagement of the second peg from the second coupling device of the appliance 38 by reducing the distance that the appliance 38 must be lifted to effect the disengagement. In addition, the second shorter peg and coupling device will disengage while the peg 15 and its cooperating coupling device remain engaged. FIG. 6 illustrates a second peg 36 which is shorter than the peg 15.

Obviously many modifications and variations of the present invention are possible in light of the above teachings. An example of such a modification would be the spring loading of the peg 36 to facilitate its disengagement from the coupling device of appliance 30 for pivoting of the appliance 35. It is therefore to be understood that, within the scope of this appended claims, the invention may be practiced otherwise than as specifically described.

What is claimd is:

1. A storage appliance which comprises:

at least first and second members formed by elongated support means having first and second spacing means extending therefrom at the ends thereof, all of said support means and spacing means having at least one flat surface with the flat surfaces of said first and second spacing means being in opposing relation to each other and generally perpendicular to the flat surface of their cooperating support means, the distal ends of said first member spacing means forming mating surfaces for said second member;

coupling means carried by each of said second member spacing means at the proximal end thereof, said coupling means having a circular aperture; and first and second peg means each being carried by a different one of said first member spacing means at the distal ends thereof for engaging said coupling means in a first mode, wherein said second member is fully supported on only one of said mating surfaces by only said first peg means and is pivotable relative to said first member, and a second mode, wherein said second member is supported on both of said mating surfaces by both of said first and second peg means and is restrained against horizontal movement relative to said first member, said first and second peg means extending beyond said mating surfaces and having a first portion of circular cross section and generally identical diameter to the diameter of said coupling means aperture and a tapered portion at its terminus with said first peg means extending a greater distance than said second peg means and remaining in engagement with its cooperating coupling means when said second member is lifted a sufficient distance from said mating surfaces to disengage said second peg means from its cooperating coupling means.

2. The storage appliance of claim 1 wherein said support means and said spacing means are formed of channels, said coupling means and said peg means being carried by said spacing means between the legs of said channels.

* * * * *